United States Patent [19]

Ishikawa et al.

[11] Patent Number: 4,996,506

[45] Date of Patent: Feb. 26, 1991

[54] BAND ELIMINATION FILTER AND DIELECTRIC RESONATOR THEREFOR

[75] Inventors: Youhei Ishikawa, Kyoto; Toshiro Hiratsuka, Muko; Hirotsugu Abe, Yokaichi; Hisashi Takagaki; Sadao Yamashita, both of Kyoto, all of Japan

[73] Assignee: Murata Manufacturing Co., Ltd., Japan

[21] Appl. No.: 414,133

[22] Filed: Sep. 28, 1989

[30] Foreign Application Priority Data

Sep. 28, 1988 [JP] Japan ..... 63-243173
Sep. 28, 1988 [JP] Japan ..... 63-126591[U]

[51] Int. Cl.[5] ..... H01P 7/10; H01P 1/20

[52] U.S. Cl. ..... 333/219.1; 333/202; 333/204; 333/227

[58] Field of Search ..... 333/204, 202, 219, 219.1, 333/206, 222, 227, 230, 229, 234, 235, 208, 212

[56] References Cited

U.S. PATENT DOCUMENTS

| | | | |
|---|---|---|---|
| 4,431,977 | 2/1984 | Sokola et al. | 333/206 |
| 4,613,838 | 9/1986 | Wada et al. | 333/232 |
| 4,639,699 | 1/1987 | Nishikawa et al. | 333/219.1 X |
| 4,652,843 | 3/1987 | Tang et al. | 333/227 X |
| 4,757,288 | 7/1988 | West | 333/204 X |
| 4,875,025 | 10/1989 | Buoli | 333/230 |

*Primary Examiner*—Eugene R. LaRoche
*Assistant Examiner*—Seung Ham
*Attorney, Agent, or Firm*—Ostrolenk, Faber, Gerb & Soffen

[57] ABSTRACT

A band elimination filter which includes at least one or more TM-mode dielectric resonators each including a ceramic casing with an electrically conductive film formed over its inner surface or outer surface, and a dielectric column disposed in a cavity in the ceramic casing, and an electrode provided on the ceramic casing, out of contact with the electrically conductive film, with transmission lines being connected to the electrode.

13 Claims, 10 Drawing Sheets

BAND ELIMINATION FILTER AND DIELECTRIC RESONATOR THEREFOR

BACKGROUND OF THE INVENTION

The present invention generally relates to a dielectric resonator including at least one dielectric column disposed within a cavity of a casing formed with an electrically conductive film over its surface.

More particularly, the present invention relates to a band elimination filter which employs a dielectric resonator including a dielectric column means provided within a ceramic casing formed with an electrically conductive film over its inner or outer surface, and also, to a dielectric filter including at least one dielectric column disposed in a ceramic casing formed with a ground electrode generally over its entire inner or outer surface.

Conventionally, band elimination filters are generally constructed from dielectric coaxial resonators or coaxial cables.

In the known band elimination filter of the above described type, however, there has been the problem that, since the quality factor Q is low, for example, in the vicinity of about 1500 to 2000; when the frequency is 800 MHZ, a sufficiently large attenuation can not be achieved, particularly in the case of a band elimination filter with a small number of stages.

Although the problem as described above is considered to be solved by a TM-mode (transverse magnetic mode) dielectric resonator having a higher quality factor Q, it has been difficult in actual practice to provide a desired band elimination filter based on such a dielectric resonator. More specifically, in order to constitute a band elimination filter, a resonator having a reactance connected in parallel therewith must be connected to a $\lambda/4$ line in a branched arrangement. However, since the TM-mode dielectric resonator as referred to above has a closed construction in which the dielectric column is provided within the cavity of a ceramic case which has an the electrically conductive film formed over its inner or outer surface, with opposite ends of the dielectric column adapted to contact said casing, there is still the disadvantage that connection thereof with an external circuit or the like is impossible unless the hard and brittle ceramic casing is subjected to drilling for the formation of holes.

FIG. 18 shows another example of a conventional band-pass filter including six dielectric columns 2 which serve as TM-mode dielectric filters. The respective dielectric columns 2 are disposed at predetermined intervals in a ceramic casing 1 in which its inner cavity is divided by a partition wall 5 Generally over an entire outer surface or inner surface of the ceramic casing 1, a ground electrode (not shown) which serves to define a cavity is formed, and each this ground electrode and one of the dielectric columns 2 equivalently form one resonator. By disposing the respective dielectric columns 2 at predetermined intervals within the cavity, the neighboring resonators are electro-magnetically coupled to each other. Accordingly, the dielectric filter shown in FIG. 18 constitutes a bandpass filter in which six resonators are coupled with each other.

For coupling the above dielectric filter with external circuits, coaxial connectors 3 and 4 which are connected with the external circuits through cables (not shown) are mounted on one side wall of the ceramic casing 1 as shown in FIG. 18. Loop antennas or the like (not particularly shown) are inserted into the cavity in the casing 1 from the respective connectors 3 and 4, whereby the resonators at the input and output stages and the external circuits are coupled through said antennas.

It is to be noted that the casing 1 is formed of a ceramic material in order to improve the temperature characteristics of the dielectric filter by making the coefficient of linear expansion of the casing 1 equal to that of the dielectric columns 2 as far as possible.

In connection with the above, a problem with the dielectric filter in which the ceramic material is employed for the casing 1, is that since the ceramic material is hard and brittle, it is very difficult to form holes for attaching the input and output connectors 3 and 4 on said casing 1.

On the other hand, it was proposed, for example, in Japanese Patent Application Tokugansho 60-298149 assigned to the same assignee as the present invention, to form poles or a pole at both sides or one side of a band-pass region for obtaining a desired band-pass region (referred to as polarization hereinafter). However, there is the problem that, although the polarization is desired in the dielectric filter as described above, realization thereof is very difficult. More specifically, in order to provide the polarization, resonators disposed at opposite sides of at least one resonator, positioned therebetween, must be coupled with each other by a reactance element, but in the dielectric filter as described so far, since all of the dielectric ,columns are sealed in the ceramic casing, it is impossible to couple two of the dielectric columns by such a reactance element without subjecting the ceramic casing to the difficult drilling for forming holes.

SUMMARY OF THE INVENTION

Accordingly, an essential object of the present invention is to provide a band elimination filter with a favorable attenuation characteristic, which employs resonators having a higher quality factor Q, without requiring the filter to be subjected to drilling or the like for the formation of holes therein.

Another object of the present invention is to provide a dielectric filter which is so arranged to permit attaching of input and output connectors or polarization components without subjecting the ceramic casing to a difficult process such as drilling.

A further object of the present invention is to provide a band elimination filter or dielectric filter of the above described type which is simple in construction and stable in its functioning, and can be readily manufactured at low cost.

In accomplishing these and other objects, according to one aspect of the present invention, there is provided a dielectric resonator which includes a ceramic casing having at least one dielectric column disposed in its cavity formed with an electrically conductive film over its surface, an electrode provided on the surface of said ceramic casing in a state of non-contact with respect to the electrically conductive film, and connecting lines for connecting the electrode with an external circuit.

In another aspect of the present invention, there is provided a band elimination filter which includes at least one or more TM-mode dielectric resonators each including a ceramic casing formed with an electrically conductive film over its inner surface or outer surface, and a dielectric column disposed in a cavity in the ceramic casing, and an electrode provided on said ceramic casing in a state of non-contact with respect to the electrically conductive film, with transmission lines being connected to said electrode.

By the arrangement according to the present invention as described above, since the electrode for connecting the transmission lines is provided on the ceramic casing for the TM-mode dielectric resonator having a high quality factor Q, in a state of non-contact with the electrically conductive film, it becomes possible to manufacture an efficient band elimination filter through employment thereof.

In a further aspect of the present invention, there is also provided a dielectric filter which includes a ceramic casing formed with a ground electrode generally over its entire inner surface and at least one dielectric column disposed within a cavity of said ceramic casing, and a strip formed on an outer surface of the ceramic casing so as to form a micro-strip line together with the ground electrode on said inner surface, with part of the strip being magnetically coupled with the dielectric column through the ceramic casing.

In a still further aspect of the present invention, there is also provided a dielectric filter which includes a ceramic casing formed with a ground electrode generally over its entire outer surface and at least one dielectric column disposed within a cavity of said ceramic casing, and strips formed on an outer surface of said ceramic casing so as to form a coplanar line together with the ground electrode, with part of the strips being magnetically coupled with the dielectric column through the ceramic casing.

In the above aspects of the present invention, by forming the strip at the predetermined position on the outer surface of the ceramic casing, the micro-strip line or coplanar line is constituted together with the ground electrode formed on the inner surface or outer surface of the ceramic casing, and part of this micro-strip line or coplanar line is magnetically coupled with the dielectric column through the ceramic casing. Accordingly, by utilizing another part of said strip as the input and output electrodes, the filter may be connected with external circuits without necessity for subjecting the ceramic casing to drilling, etc. for making holes. Moreover, it is possible to effect magnetical coupling with other dielectric columns through utilization of another part of the strip, and in this case, polarization may also be effected.

BRIEF DESCRIPTION OF THE DRAWINGS

These and other objects and features of the present invention will become apparent from the following description of several preferred embodiments thereof with reference to the accompanying drawings, in which.

DETAILED DESCRIPTION OF THE INVENTION

Figure 1:
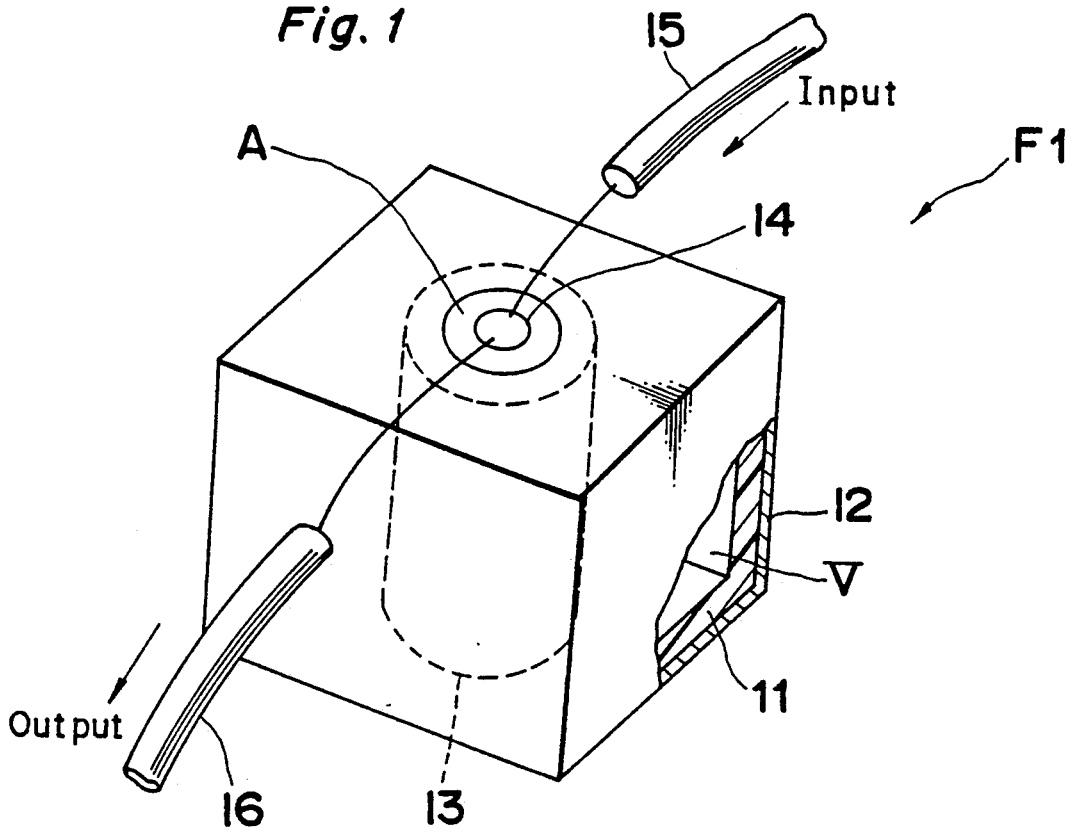
FIG. 1 is a schematic perspective view of a band elimination filter according to one preferred embodiment of the present invention.

Before the description of the present invention proceeds, it is to be noted that like parts are designated by like reference numerals throughout the accompanying drawings.

First embodiment and modifications thereof

Figure 2:
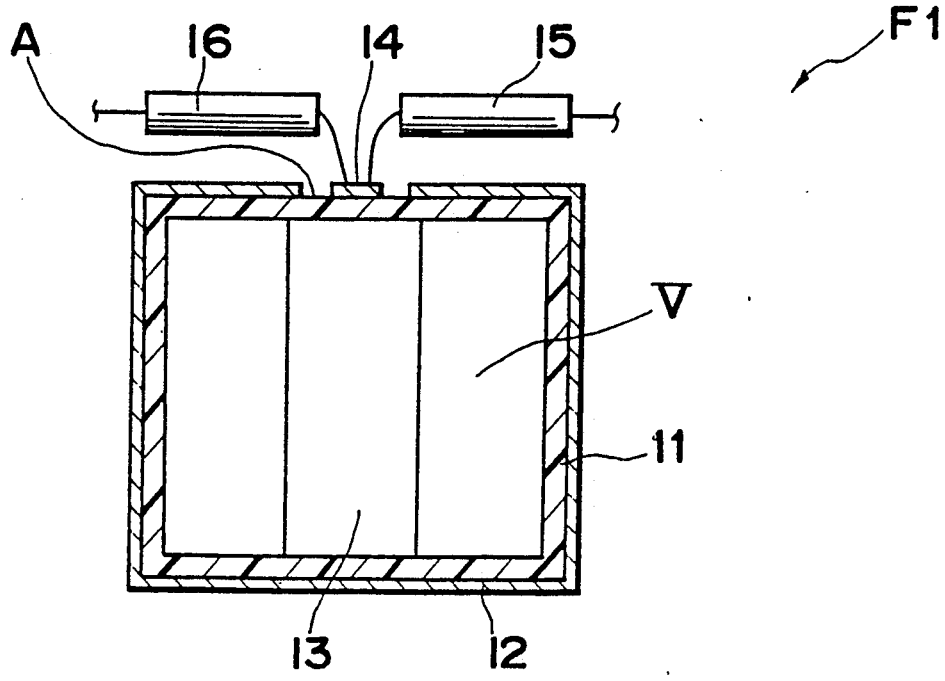
FIG. 2 is a cross sectional view of the band elimination filter of FIG. 1.
Figure 3:
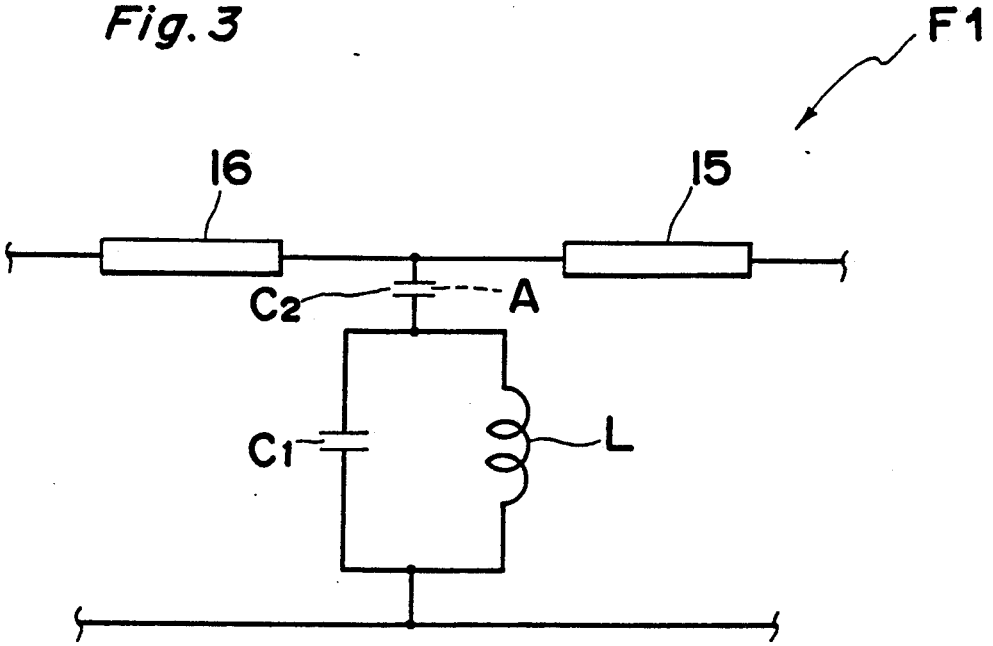
FIG. 3 is an electrical diagram showing an equivalent circuit of the filter of FIG. 1, FIGS. 4,5,6 and 8 are perspective views respectively showing modifications of the band elimination filter of FIG. 1.

Referring now to the drawings, there is shown in FIGS. 1 to 3, a band elimination filter F1 according to one preferred embodiment of the present invention.

In FIGS. 1 and 2, the band elimination filter F1 includes a casing 11 of a ceramic material formed with an electrically conductive film 12 over its outer surface, and a dielectric column 13 also of a ceramic material provided within a cavity V formed in said ceramic casing 11, with opposite ends of said dielectric column 13 contacting said casing 11, thus constituting a dielectric resonator of the TM-mode.

The electrically conductive film 12 referred to above is made of Ag, for example, and is formed by baking after being applied by a screen printing, for example, over the entire outer surface of the casing 11 except for a portion A of the casing 11 located above the copper end of said dielectric column 13. At the portion A of the casing 11, an electrode 14 of a similar conductive material, for example Ag, is formed by application and baking. The electrode 14 does not contact the conductive film 12. Transmission lines 15 and 16 of $\lambda/4$ length for input and output are connected to said electrode 14.

Accordingly, a capacitor C2 is equivalently formed between the electrode 14 and the upper surface of the dielectric column 13 through the ceramic casing 11 (FIG. 3).

Thus, the above arrangement of FIGS. 1 and 2 constitutes a one stage band elimination filter represented by an equivalent circuit including a parallel connection of a capacitor C1 and a coil L, which is connected to the transmission lines 15 and 16 through the capacitor C2 as shown in FIG. 3.

Figure 4:
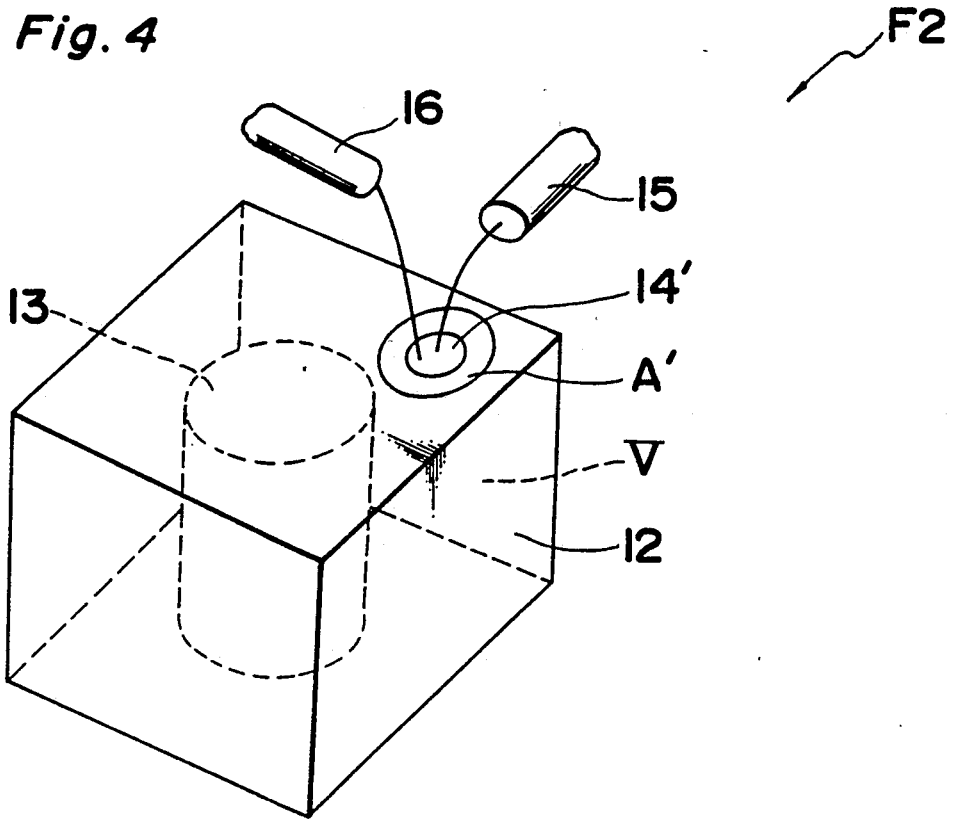
Figure 5:
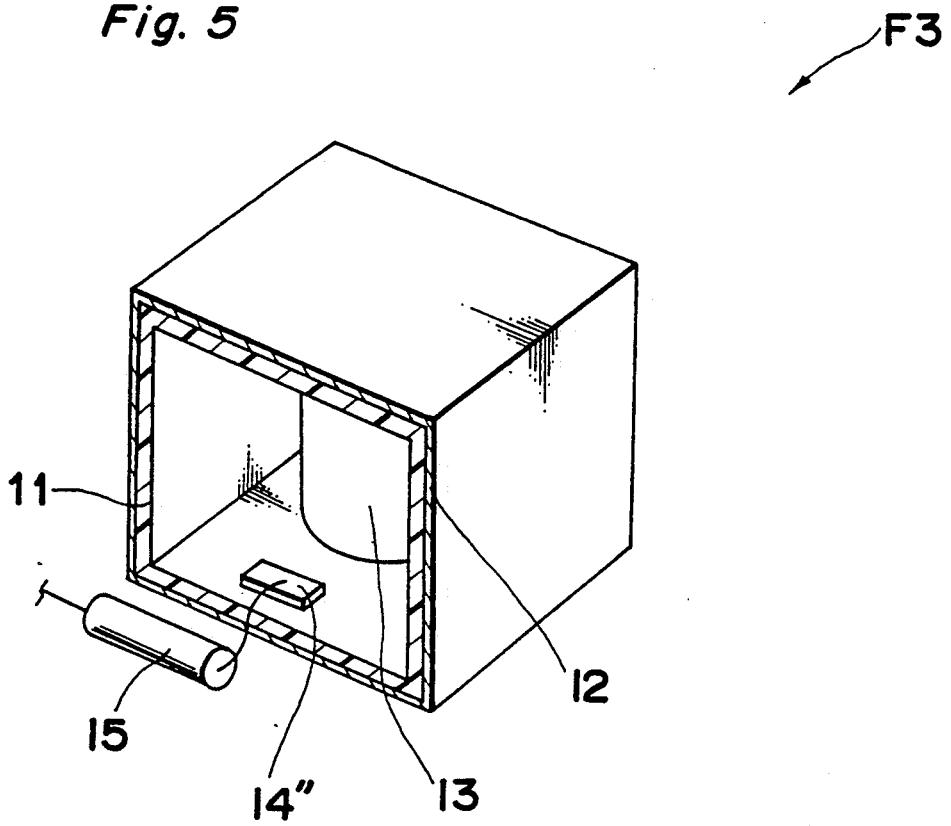

It should be noted here that, in the foregoing embodiment, although the electrode 14 is formed at the portion A of the casing 11 located directly above the upper end of the dielectric column 13, in order to increase the capacitance of the capacitor C2, the arrangement according to the present invention is not limited in its application to the above, but may be so modified. For example, FIG. 4 shows a filter F2 having an electrode 14' at a portion A' of the casing 11 spaced from the portion A above the dielectric column 13. As in FIGS. 1–3, the electrode 14' does not contact the conductive film 12 According to another alternative, shown in FIG. 5, the electrode 14 provided on the casing 11, at the portion A above the upper end of the dielectric column 13 in FIG. 1, may also be replaced by an electrode 14'' formed on the inner bottom surface of the casing 11 at a position adjacent to the lower end of the dielectric column 13, in a modified band elimination filter F3. In a further modification, shown in FIG. 8, an electrode 14''' is formed on the inner bottom surface of the casing 11, as is the conductive film 12, and the electrode 14''' extends forwardly from under the dielectric column 13 without contacting said film 12 in the filter F5.

Figure 6:
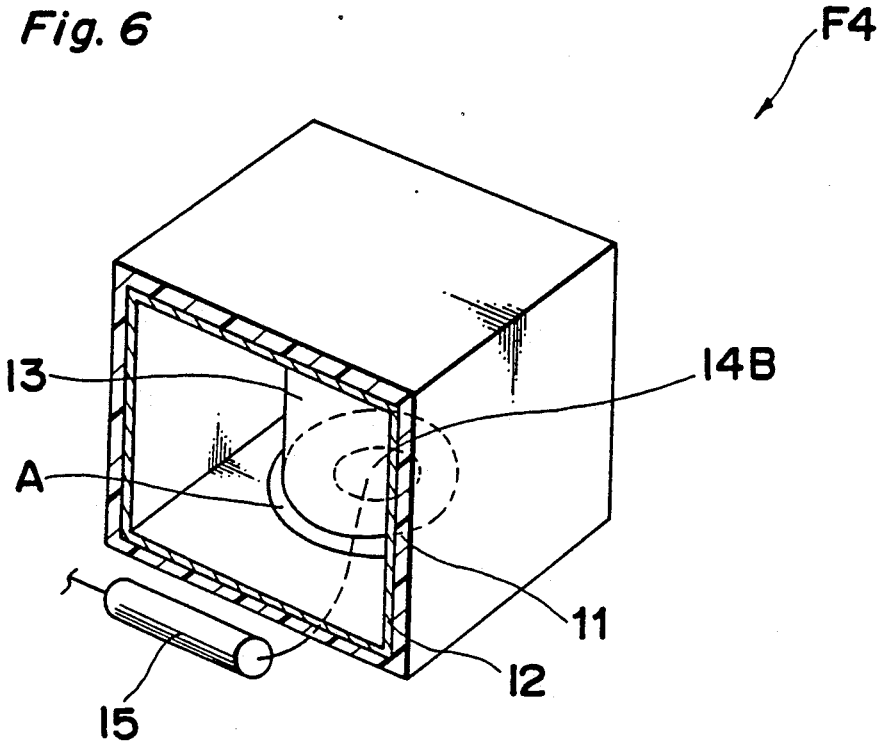
Figure 7:
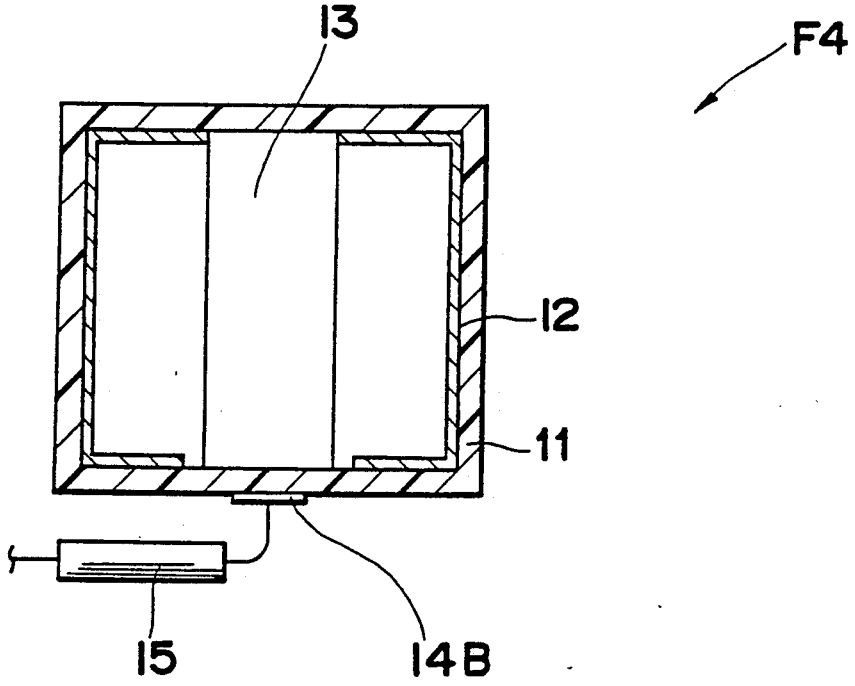
FIG. 7 is a cross sectional view of the band elimination filter of FIG. 6.
Figure 8:
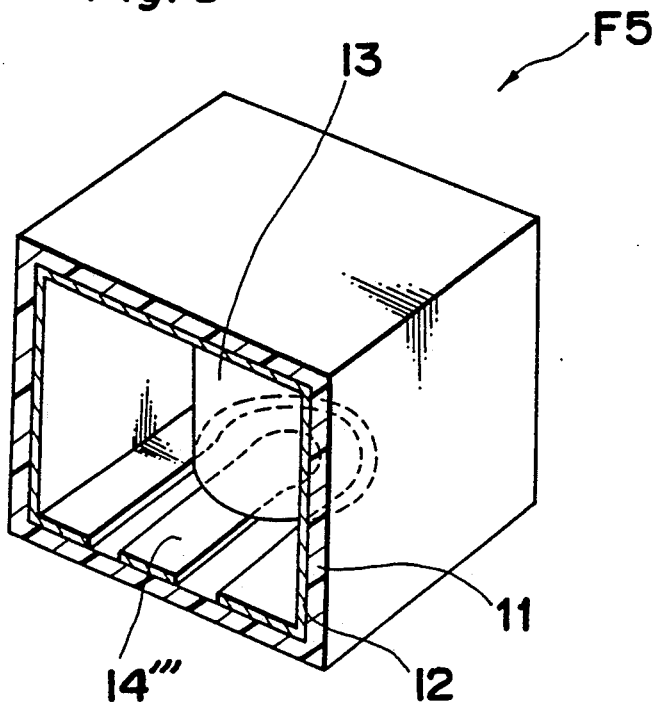

It should also be noted here that although in some of the foregoing embodiments, although the conductive film 12 is described as being formed over the outer surface of the ceramic casing 11, the present invention is not limited in its application to such arrangement alone, but may, for example, be modified by forming the conductive film 12 over the inner surface of the ceramic casing 11, as in the embodiment of FIG. 8. Or, as shown in FIG. 6, the conductive film 12 may be formed over the inner surface of the ceramic casing 11 while the electrode 14B is being formed on the outer surface of the casing 11 in a position below the lower end of the dielectric column 13, in a further modified filter F4. In the above case, however, as best seen in FIG. 7, it is not necessary to form theconductive film 12 on the inner surface of the casing confronting the upper end of the dielectric column 13. In other words, if the upper end were to contact the conductive film 12, no capacitor could be formed between the upper face of the dielectric column 13 and the electrode 14, and thus, it would become impossible to produce a band elimination filter.

Figure 9:
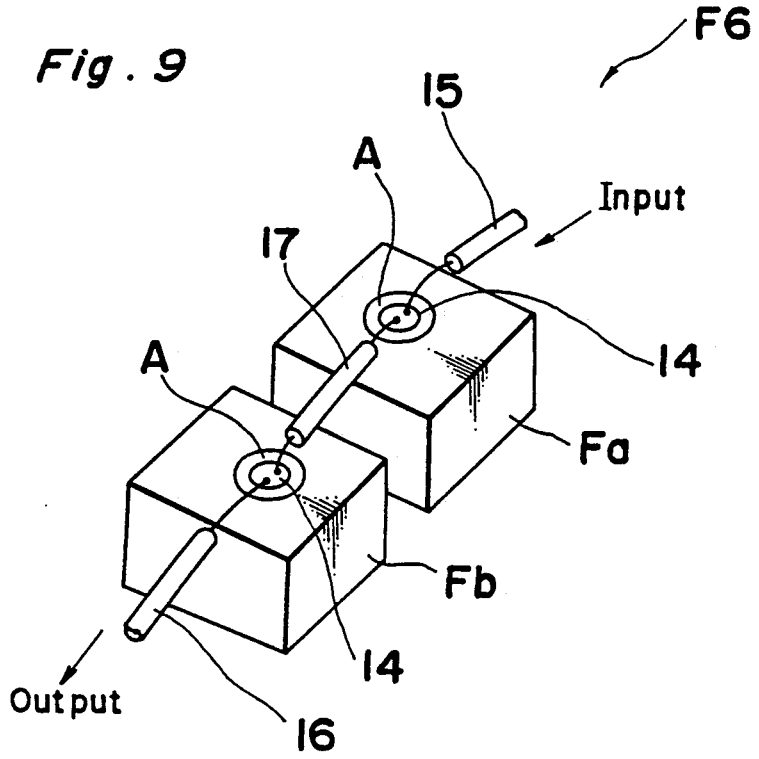
FIG. 9 is a perspective view of a band elimination filter having a plurality of stages to which the present invention is applied.

FIG. 9 shows another modification in which the dielectric resonator of FIG. 1 is applied to a band elimination filter F6, two stages. In this filter F6 in two dielectric resonators Fa and Fb of TM-mode, each formed with the conductive film 12 and the electrode 14 as described earlier with reference to FIGS. 1 to 3, are coupled to each other in such a manner that the input transmission line 15 is connected to the electrode 14 of one resonator Fa, and the output transmission line 16, to the electrode 14 of the other resonator Fb, while a $\lambda/4$ transmission line 17 is connected at its two opposite ends to the electrodes 14 of both resonators Fa and Fb as shown.

By employing dielectric resonators in multiple-stages as in the two-stage band elimination filter F6 described above, it is possible to further improve the attenuation characteristic of the filter.

Figure 10:
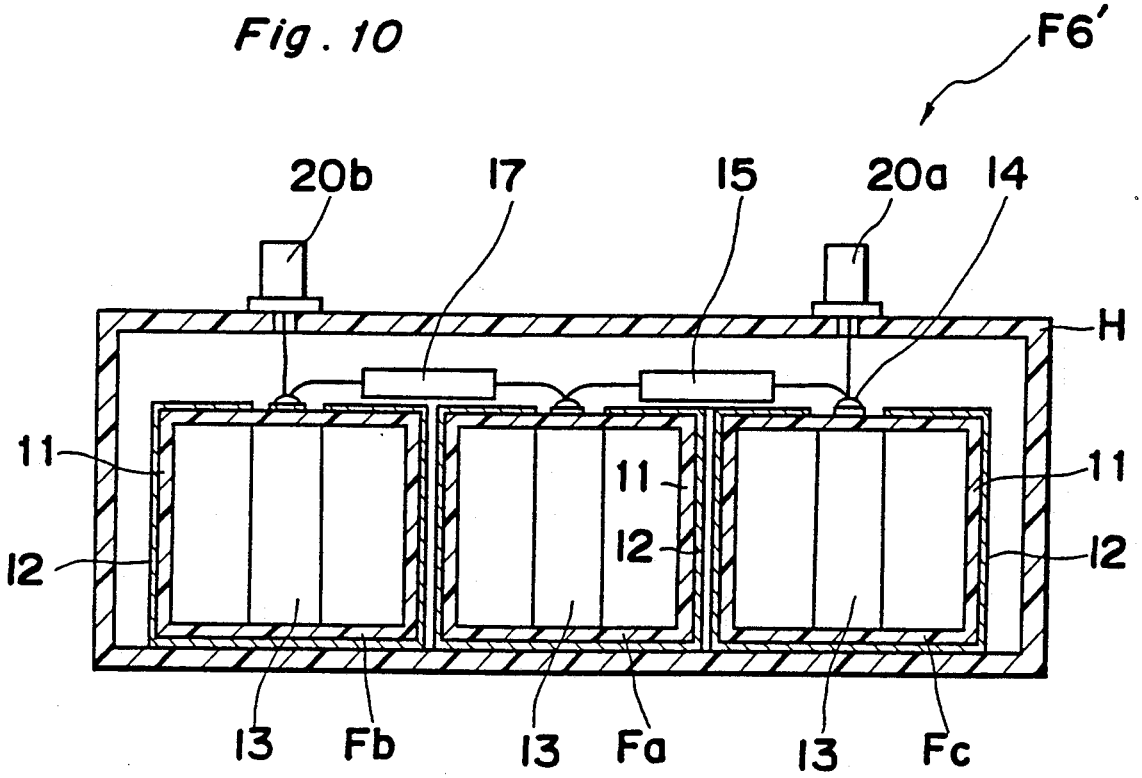
FIG. 10 is a cross sectional view of the filter of FIG. 9 accommodated in a housing.
Figure 11:
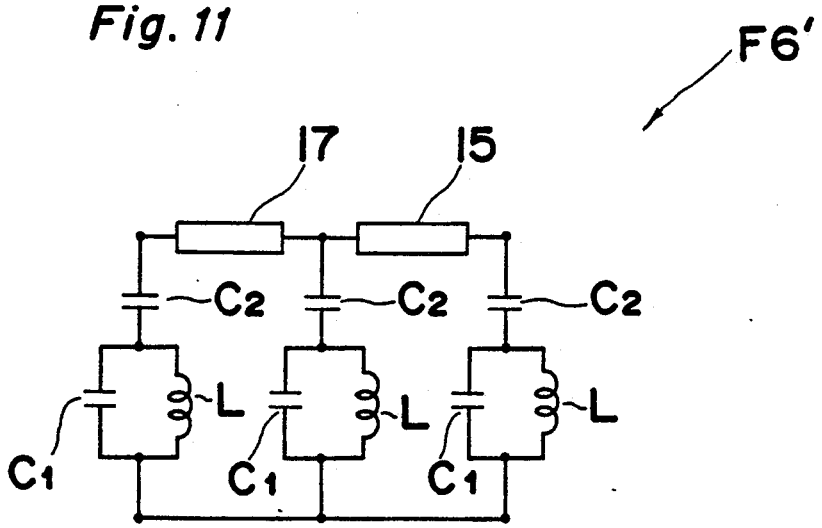
FIG. 11 is an electrical diagram showing an equivalent circuit of the filter of FIG. 9.

In a further modified band elimination filter F6' shown in FIGS. 10 and 11, the embodiment of FIG. 9 is modified by providing a third resonator Fc. The input end of the transmission line 15 is connected to the electrode 14 of the third resonator Fc and also to an input terminal **20*a* mounted on a housing H in which the resonators Fa, Fb and Fc are accommodated, while the output end of the transmission line 16 is connected to an output terminal 20*b* mounted on the housing H as represented by an equivalent circuit shown in FIG. 11**.

Figure 12:
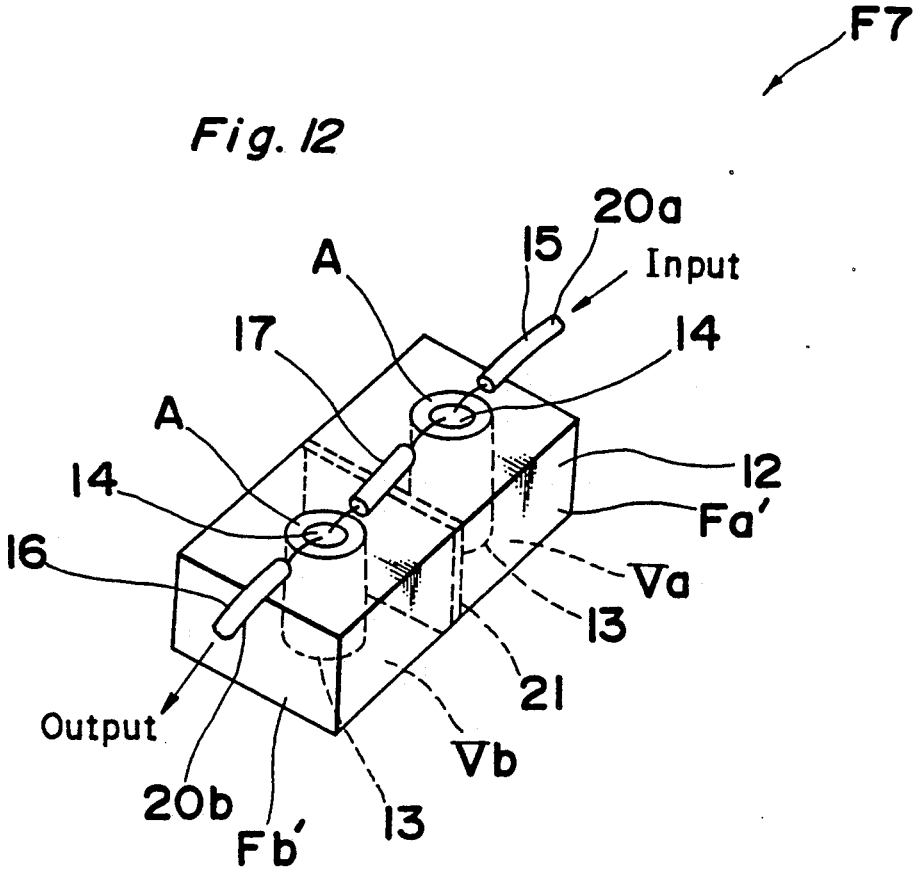
FIG. 12 is a perspective view of a dielectric resonator including two dielectric columns provided within a ceramic casing, to which the present invention is applied.

FIG. 12 shows another modified band elimination filter F7 in which the present invention is applied to the dielectric resonators, wherein dielectric columns 13 are provided in two cavities Va and Vb constituted by partitioning the interior of one ceramic casing 11 with a partition plate 21. In the filter F7, the conductive film 12 is formed over the entire outer surface of the casing 11 except for the two portions A above the upper ends of the dielectric columns 13, with the electrodes 14 respectively formed on said two portions A, not contacting the rest of the conductive film 12. The input transmission line 15 is connected to one electrode 14, while the output transmission line 16 is connected to the other electrode 14, and the $\lambda/4$ transmission line 17 is connected at its opposite ends to both of the electrodes 14 as illustrated. The other ends of the transmission lines 15 and 16 are respectively connected to the input and output terminals **20*a* and 20*b* (not shown specifically) in a similar manner as in the filter F6'**.

It is needless to say that the present invention may also be applied to dielectric resonators in which more than three dielectric columns are provided in one ceramic casing.

It should be noted here that, since the band elimination filter according to the present invention employs the dielectric resonators including the ceramic casing, the coefficient of linear expansion of the ceramic casing may be readily matched or substantially matched to that of the dielectric columns, and thus, separation of the casing and dielectric columns does not take place during sintering of the like, thus providing a favorable electrical characteristics.

In the arrangement according to the first embodiment of the present invention as described so far, the electrode for connecting the transmission lines is provided on the inner or outer surface of the ceramic casing of the dielectric resonator with a high quality factor Q, not contacting the conductive film forming the cavity, and therefore, it becomes possible to manufacture the band elimination filter by connecting to the transmission lines through utilization of said electrode, whereby band elimination filters having a favorable attenuation characteristic may be advantageously provided.

Second embodiment and modifications thereof

Figure 13:
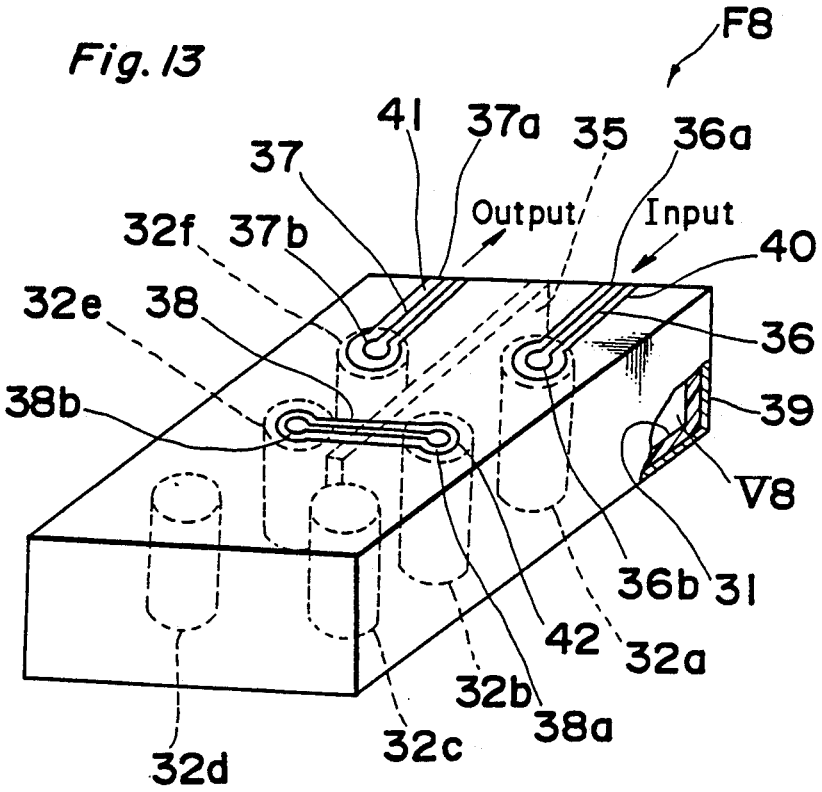
FIG. 13 is a schematic perspective view showing a dielectric filter according to a second embodiment of the present invention.
Figure 14:
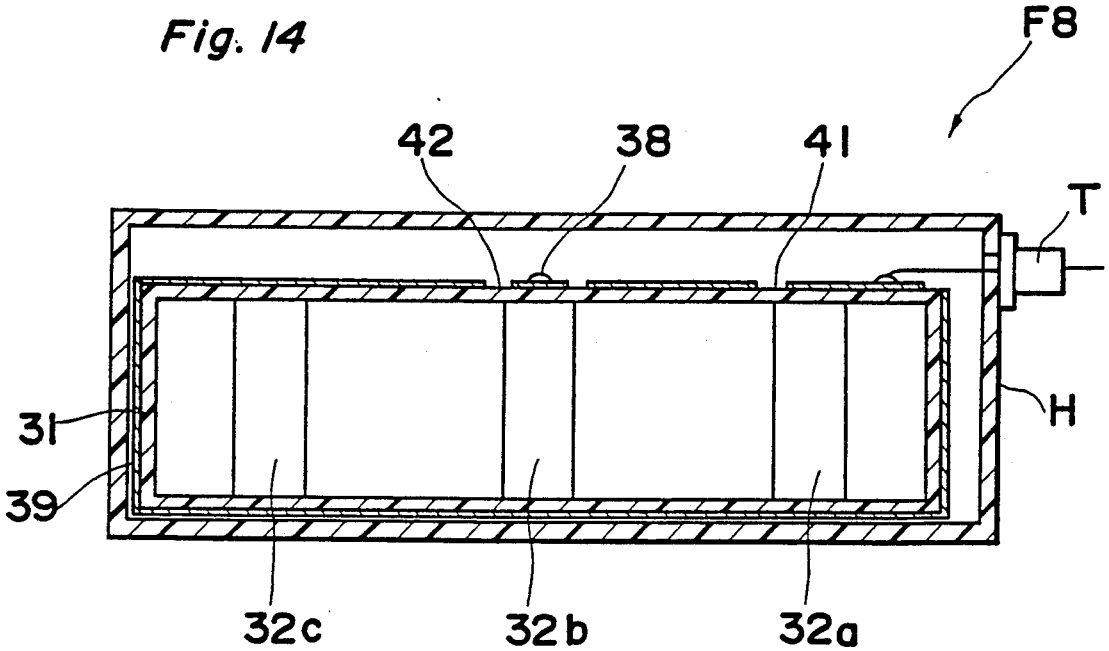
FIG. 14 is a cross sectional view of the filter of FIG. 13 accommodated in a housing.
Figure 15:
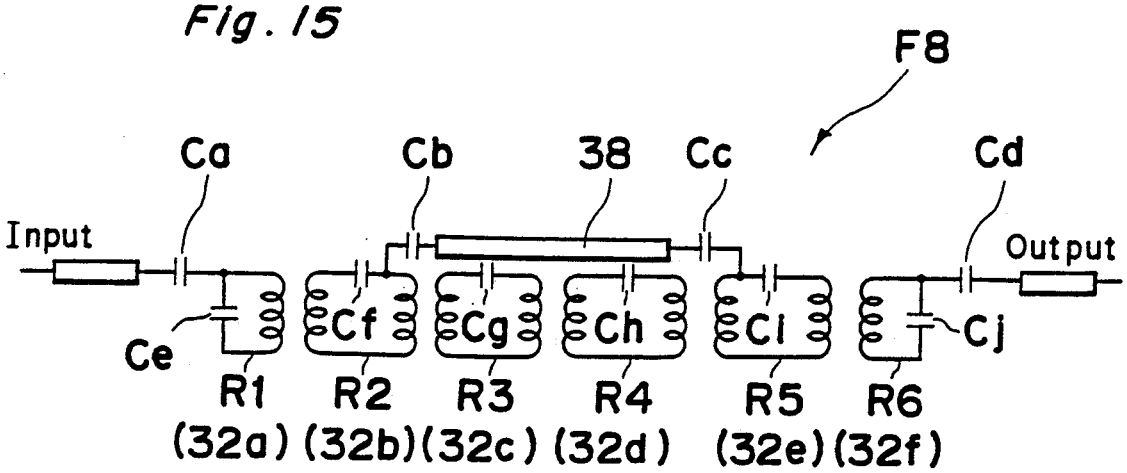
FIG. 15 is an electrical diagram showing an equivalent circuit of the filter of FIG. 13.

Referring further to FIGS. 13 to 15, there is shown a dielectric band pass filter F8 to which the present invention is applied.

The filter F8 includes a casing 31 of a ceramic material formed, for example, into a right hexahedron, in which a partition plate 35 made of a similar ceramic material having a length approximately $\frac{2}{3}$ of the length of said casing 31 and formed with a shielding electrode film, is provided in a position at a central portion in the direction of width of the casing 31, with one end of the plate 35 in the longitudinal direction contacting the corresponding inner side wall of said casing, whereby a cavity V8 generally in a U-shape is formed by said partition plate 35 within the casing 31. In the cavity V8, for example, six dielectric columns 32*a*, 32*b*, 32*c*, 32*d*, 32*e* and 32*f* of a ceramic material are provided at a predetermined interval.

Figure 18:
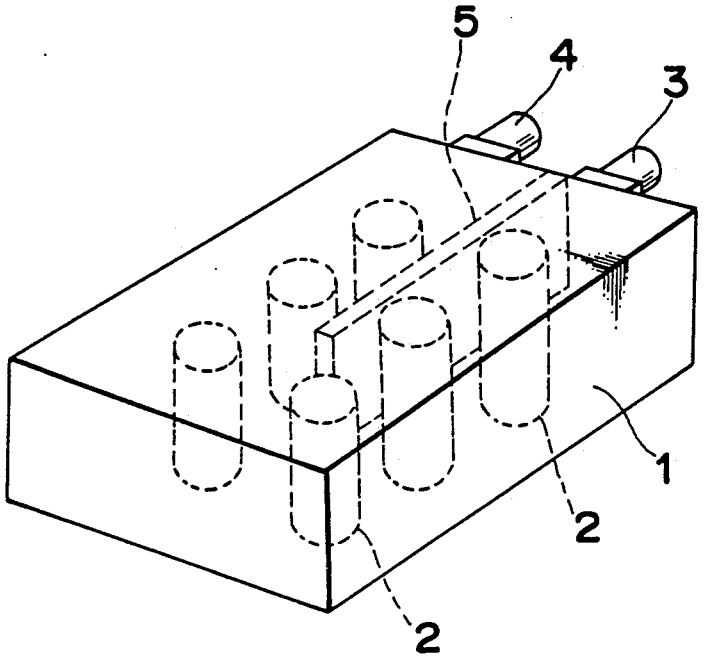
Fig. 18 PRIOR ART
FIG. 18 is a schematic perspective view showing the construction of a conventional dielectric filter (already referred to)

Generally over the entire outer surface of the ceramic casing 31, a ground electrode film 39 made of a conductive material such as Ag or the like is formed. Such fundamental construction is generally similar to that of the conventional arrangement of FIG. 18, and thus, in an equivalent circuit construction, a band-pass filter is formed in which six resonators are magnetically coupled in series (FIG. 15).

As shown by numerals 40, 41 and 42, the ground electrode 39 at the upper outer surface of the ceramic casing 39 is separated or peeled off at portions including the upper portions of the dielectric columns 32*a*, 32*b*, 32*e* and 32*f*, with strips 36, 37 and 38 made of a thin metallic film being formed at said peeled portions 40, 41 and 42. These strips 36, 37 and 38 form a coplanar line together with the ground electrode film 39.

The strips 36 and 37 are extended at end portions 36*a* and 37*a* thereof up to the corresponding edge of the casing 31, while the other ends 36*b* and 37*b* of said strips are located above the upper portions of the dielectric columns 32*a* and 32*f* at the first and sixth stages. The end portions 36*a* and 37*a* of the strips 36 and 37 are utilized as connecting portions for connection to external circuits (not shown), while the other ends 36*b* and 37*b* thereof are used as coupling electrodes for magnetic coupling with the dielectric columns 32*a* and 32*f* through the ceramic casing 31. These end portions 36*b* and 37*b* have an enlarged electrode area in order to obtain the necessary coupling with respect to the dielectric columns 32*a* and 32*f*.

Another strip 38 has its one end 38*a* positioned above the second stage dielectric column 32*b*, and the other end 38*b* thereof, above the fifth stage dielectric column 32*e*. Accordingly, the two dielectric columns 32*b* and 32*e* are magnetically coupled to each other through the opposite ends 38*a* and 38*b* of the strip 38. Since the magnetic coupling equivalently forms reactance, polarization of the band-pass filter may be achieved by said strip 38.

The filter V8 having the construction as described above may be represented by an equivalent circuit shown in FIG. 15, in which R1, R2, R3, R4, R5 and R6 denote resonators formed between the casing 31 and the respective dielectric columns 32*a*, 32*b*, 32*c*, 32*d*, 32*e* and 32*f*, with capacitance formed in the circuit being represented by Ca to Cj.

Figure 16:
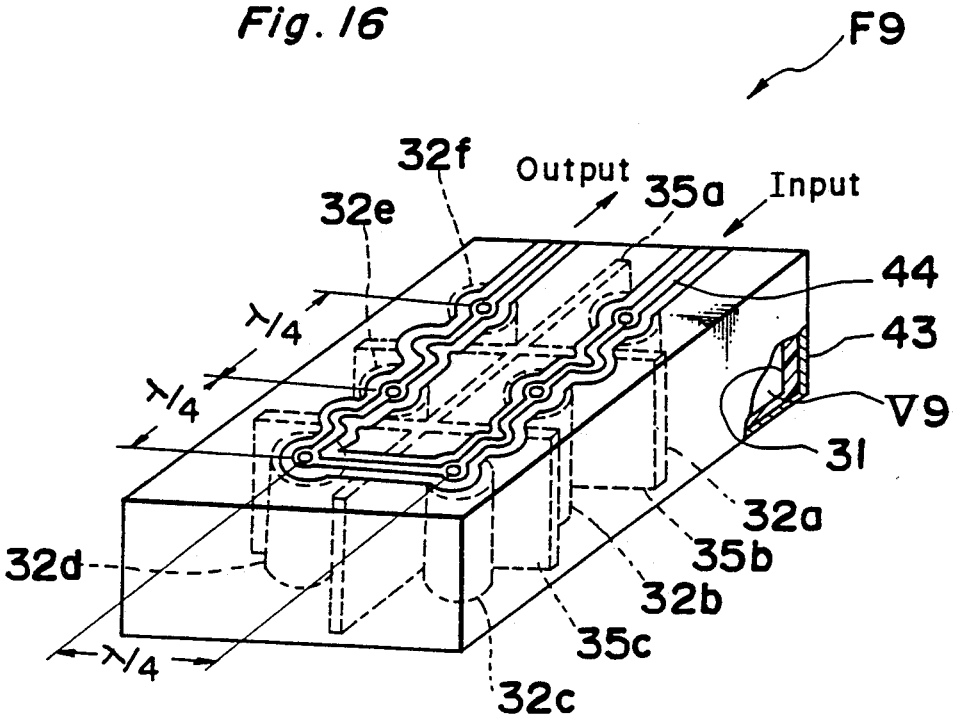
FIG. 16 is a perspective view showing a band elimination filter according to another modification of the present invention.
Figure 17:
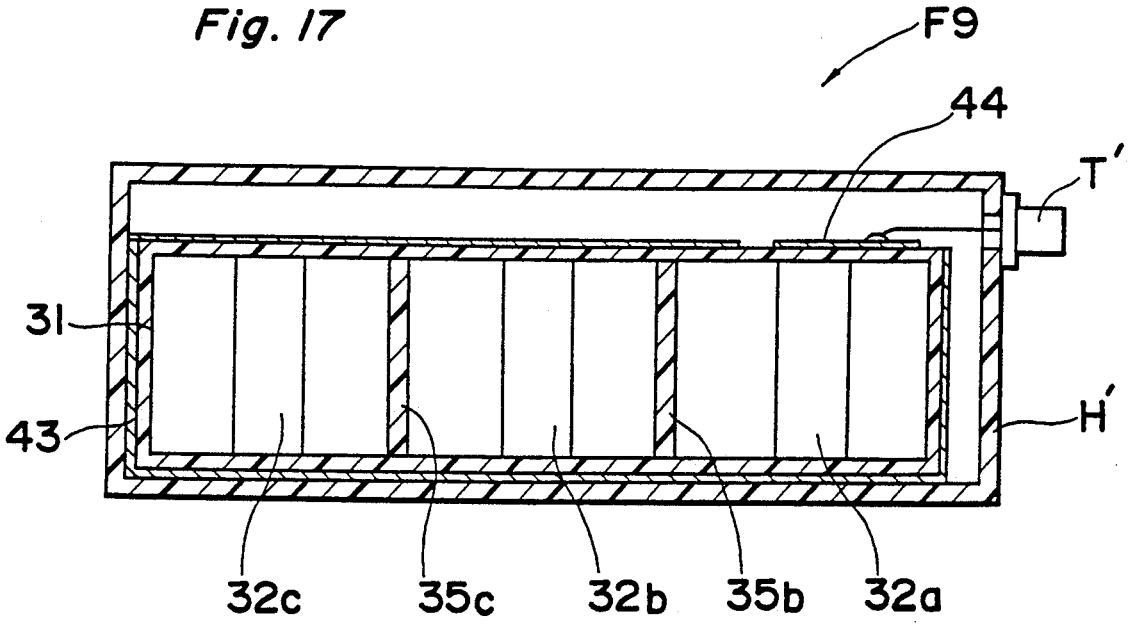
FIG. 17 is a cross sectional view of the filter of FIG. 16 accommodated in a housing.
Figure 19:
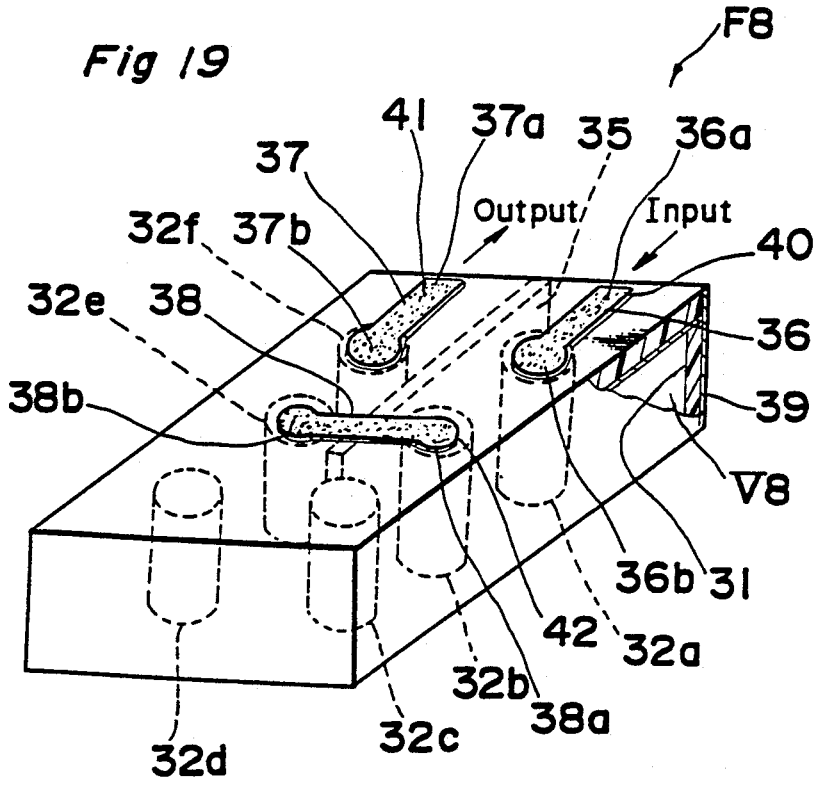
FIG. 19 is a schematic perspective view of a dielectric filter corresponding to that shown in FIG. 13, but having a ground electrode formed on the inner surface of the ceramic casing.
Figure 20:
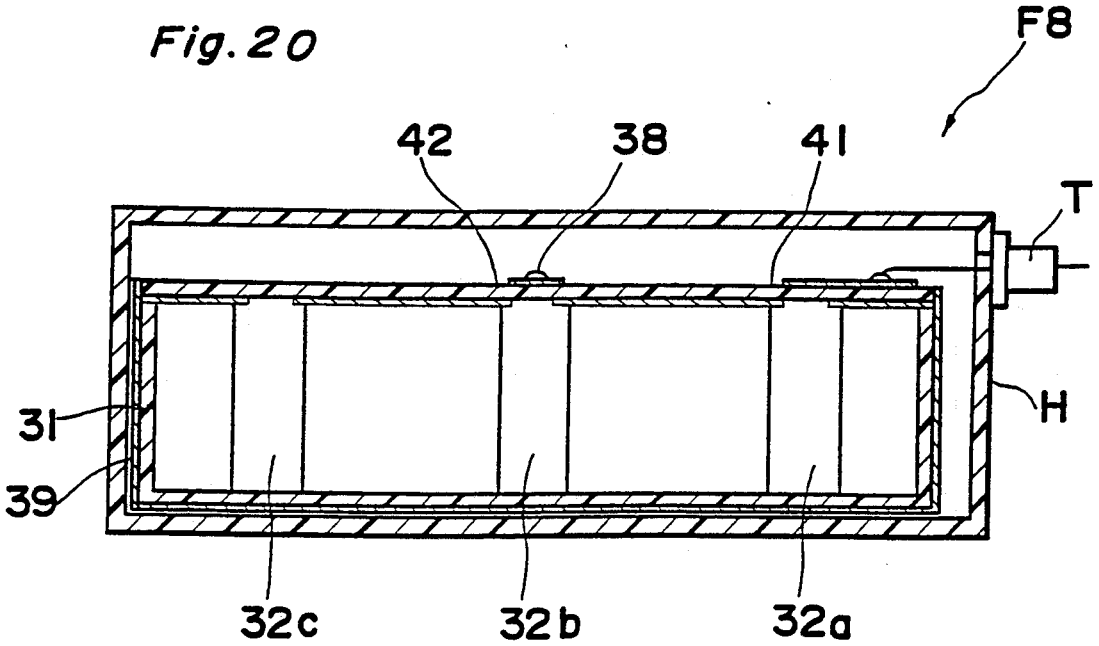
FIG. 20 is a cross sectional view of the filter of FIG. 19 accommodated in a housing.

FIGS. 19 and 20 are views respectively similar to those in FIGS. 13 and 14, but showing a filter F8 having a conductive film formed generally over the entire inner surface of the ceramic casing 31. The filter of FIGS. 19 and 20 has the equivalent circuit shown in FIG. 15. FIGS. 16 and 17 show a modification of the filter F8 as applied to a band elimination filter. In FIGS. 16 and 17, the modified filter F9 includes the similar casing 31 of a ceramic material formed with a ground electrode film 43 generally over its entire outer surface, three partition plates 35*a*, 35*b* and 35*c* made of ceramic plates formed with shielding electrode films thereover and connected to each other to divide the interior of the casing 31 into six cavities V9 as shown, and dielectric columns 32*a*, 32*b*, 32*c*, 32*d*, 32*e* and 32*f* provided in the respective cavities.

On the upper surface of the casing 31, a strip 44 of a conductive material, for example, of Ag is formed in a U-shape, starting from one edge of the casing 31 in the longitudinal direction and returning to said one edge by passing over the respective dielectric columns 32*a*, 32*b*, 32*c*, 32*d*, 32*e* and 32*f*. This strip 44 is adapted to have a length of $\lambda/4$ ($\lambda$ represents wavelength in waveguide) between each respective pair of dielectric columns 32*a* to 32*f*.

It should be noted here that, in the foregoing embodiments, although the present invention has been mainly described with reference to the ceramic casings formed with the ground electrode film over the outer surfaces thereof, the concept of the present invention is not limited in its application to the casings of this kind alone, but may be applied to a ceramic casing formed with the ground electrode film over its inner surface, in which case, a micro-strip line is to be formed by the combination of the strip on the outer surface and the ground electrode. In this case, it is necessary to remove the ground electrode film where the strip confronts the upper surface of the dielectric column, in order to achieve the coupling between the strip and the dielectric column.

As is clear from the foregoing description, according to the arrangement of the second embodiment of the present invention, the strips which constitute the strip line or coplanar line (together with the ground electrode film formed over the inner or outer surface of the ceramic casing), are formed on the outer surface of the ceramic casing, for the magnetic coupling with respect to the dielectric column provided inside. Thus, the difficult drilling of the ceramic casing for the formation of holes, etc. becomes unnecessary, whereby providing input and output connections, and also, polarization, are advantageously made possible.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric resonator which comprises a ceramic casing having at last one dielectric column disposed in a cavity thereof and said casing having an electrically conductive film formed over its outer surface, an electrode constituted by a metallic film formed on the outer surface of said ceramic casing, separated from said electrically conductive film by a gap, and opposing an end of said dielectric column through a portion of said casing, and connecting lines for connecting said electrode with an external circuit.

2. A band elimination filter which comprises at least one TM-mode dielectric resonator, each including a ceramic casing having an electrically conductive film formed over one of its inner and outer surfaces, and a dielectric column disposed in a cavity in said ceramic casing, an electrode provided on said ceramic casing and out of contact with said electrically conductive film, said electrode being constituted by a metallic film formed on the outer surface of said casing and being separated from said electrically conductive film by a gap and opposing an end of said dielectric column through a portion of said casing, with transmission lines being connected to said electrode.

3. A band elimination filter as claimed in claim 2, wherein said ceramic casing has the electrically conductive film formed generally over its entire outer surface, and one dielectric column is disposed within the cavity, with its opposite ends contacting said casing, and said electrode is provided on a portion of the casing above an upper end of said dielectric column so as not to be in contact with said electrically conductive film.

4. A band elimination filter as claimed in claim 2, wherein said ceramic casing has the electrically conductive film formed generally over its entire outer surface, and one dielectric column is disposed within the cavity, with its opposite ends contacting said casing, and said electrode is provided on a portion of the casing spaced from its portion above an upper end of said dielectric column so as not to be in contact with said electrically conductive film.

5. A band elimination filter which comprises at least one TM-mode dielectric resonator, each including a ceramic casing having an electrically conductive film formed over one of its inner and outer surfaces, and a dielectric column disposed in a cavity in said ceramic casing, and an electrode provided on said ceramic casing and out of contact with said electrically conductive film, with transmission lines being connected to said electrode, wherein said ceramic casing has the electrically conductive film formed generally over its entire outer surface, and one dielectric column is disposed within the cavity, with its opposite ends contacting said casing, and said electrode is provided on the inner bottom surface of the casing at a position adjacent to the lower end of dielectric column so as not to be in contact with said electrically conductive film.

6. A band elimination filter which comprises at least one TM-mode dielectric resonator, each including a ceramic casing having an electrically conductive film formed over one of its inner and outer surfaces, and a dielectric column disposed in a cavity in said ceramic casing, and an electrode provided on said ceramic casing and out of contact with said electrically conductive film, with transmission lines being connected to said electrode, wherein said ceramic casing has the electrically conductive film formed generally over its entire inner surface, and one dielectric column is disposed within the cavity, with its opposite ends contacting said casing, and said electrode is provided on an outer surface of the casing in a position below the lower end of the dielectric column so as not to be in contact with said electrically conductive film.

7. A band elimination filter which comprises at least one TM-mode dielectric resonator, each including a ceramic casing having an electrically conductive film formed over one of its inner and outer surfaces, and a dielectric column disposed in a cavity in said ceramic casing, and an electrode provided on said ceramic casing and out of contact with said electrically conductive film, with transmission lines being connected to said electrode, wherein said ceramic casing has the electrically conductive film formed generally over its entire inner surface, and one dielectric column is disposed within the cavity, with its opposite ends contact said casing, and said electrode is provided on a bottom portion of the casing along with the conductive film to extend away from under the dielectric column so as not to be in contact with said electrically conductive film.

8. A band elimination filter as claimed in claim 2, further including a second TM-mode dielectric resonator having the same construction as the first TM-mode dielectric resonator, with an input transmission line being connected to the electrode of said first resonator, and an output transmission line, to the electrode of said second resonator, said electrodes of said first and second resonators being connected to opposite ends of a transmission line of $\lambda/4$ wavelength.

9. A band elimination filter as claimed in claim 2, wherein the interior of said ceramic casing is divided into two cavities by a partition wall of a similar ceramic material with a shielding effect, said first resonator being disposed in one of the cavities, and a second resonator having the same construction as said first resonator being formed in the other of said cavities, with an input transmission line being connected to the electrode of said first resonator, and an output transmission line, to the electrode of said second resonator, said electrodes of said first and second resonators being connected to opposite ends of a transmission line of $\lambda/4$ wavelength.

10. A dielectric filter which comprises a ceramic casing formed with a ground electrode generally over its entire inner surface and at least one dielectric column disposed within a cavity or said ceramic casing, and a strip formed on an outer surface of said ceramic casing so as to form a micro-strip line, together with said ground electrode on said inner surface, part of said strip being capacitively coupled with said dielectric column through said ceramic casing;

said strip being constituted by a metallic film formed on the outer surface of said casing and being separated from said ground electrode by a gap and opposing an end of said dielectric column through a portion of said casing.

11. A dielectric filter which comprises a ceramic casing formed with a ground electrode generally over its entire outer surface and at least one dielectric column disposed within a cavity of said ceramic casing, and strips formed on an outer surface of said ceramic casing so as to form a coplanar line together with said ground electrode, part of said strips being capacitively coupled with said dielectric column through said ceramic casing.

12. A dielectric filter as claimed in claim 10, further including a housing in which said dielectric filter is accommodated and connected to an input and output terminal means of said housing.

13. A dielectric filter as claimed in claim 11, further including a housing in which said dielectric filter is accommodated and connected to an input and output terminal means of said housing.

* * * * *